US006029917A

United States Patent [19]

Jensen

[11] Patent Number: 6,029,917

[45] Date of Patent: Feb. 29, 2000

[54] ARRANGEMENT FOR SECURING A REPLACEABLE CUTTING BLADE ON A ROTATING KNIFE HOLDER IN A CUTTING ASSEMBLY FOR A MEAT MINCING MACHINE

[75] Inventor: Hilmer Jensen, Skælskør, Denmark

[73] Assignee: Wolfking Danmark A/S, Slagelse, Denmark

[21] Appl. No.: 09/092,996

[22] Filed: Jun. 8, 1998

[30] Foreign Application Priority Data

Jun. 12, 1997 [DK] Denmark ..... 0688/97

[51] Int. Cl.[7] ..... B02C 18/30

[52] U.S. Cl. ..... 241/27; 241/292.1; 241/300; 241/82.1

[58] Field of Search ..... 241/82.1, 291, 241/292.1, 300, 82.2, 27, 30

[56] References Cited

U.S. PATENT DOCUMENTS

| | | | |
|---|---|---|---|
| 1,033,001 | 7/1912 | Ganzhorn . | |
| 2,259,623 | 10/1941 | Dieckmann . | |
| 5,092,528 | 3/1992 | Rudibaugh | 241/65 |
| 5,769,340 | 6/1998 | Jean | 241/207 |
| 5,791,570 | 8/1998 | Quadrana | 241/82.5 |

FOREIGN PATENT DOCUMENTS

| | | |
|---|---|---|
| 118 745 | 3/1901 | Germany . |
| 802 044 | 2/1951 | Germany . |

*Primary Examiner*—John M. Husar
*Attorney, Agent, or Firm*—Pennie & Edmonds LLP

[57] ABSTRACT

Arrangement for securing a replaceable cutting blade (1) on a rotating knife holder (2) in a cutting assembly for a meat mincing machine, the blade (1) of the rotating knife holder (2) rotating along the surface of a perforated disc (3), the arrangement comprising at least one slot (4) in the knife holder (2) adapted to the thickness of the cutting blade (1) in such a way that the replaceable cutting blade (1) can be positioned in the slot (4) and thereby partially secured in the knife holder (2). The arrangement comprises a screw (5) positioned in a threaded bore (6) provided in the knife holder (2), the threaded bore extending transversely with respect to the slot (4) in such a way that the screw (5) can be moved in the threaded bore (2) to engagement with a replaceable cutting blade (1) inserted into the slot for completely securing the blade in the knife holder (2). The threaded bore (6) is provided as a blind hole with a minor hole at the bottom for insertion of a tool for tightening the screw (5). By this arrangement it is achieved that the screw (5) is prevented from falling out of the arrangement and into the product.

11 Claims, 2 Drawing Sheets

ARRANGEMENT FOR SECURING A REPLACEABLE CUTTING BLADE ON A ROTATING KNIFE HOLDER IN A CUTTING ASSEMBLY FOR A MEAT MINCING MACHINE

TECHNICAL FIELD

The present invention relates to an arrangement for securing a replaceable cutting blade on a rotating knife holder in a cutting assembly for a meat mincing machine. The cutting assembly comprises in the usual way at least one stationary perforated disc and a rotating knife having a blade rotating along the surface of the perforated disc.

BACKGROUND ART

Mounting arrangements are known, comprising at least one slot in the knife holder, adapted to the thickness of the cutting blade in such a way that the replaceable blade can be positioned in the slot and thereby partly be fixed in the knife holder. Usually, further means are needed in order to secure the replaceable cutting blades radially in the knife holder, which e.g. is done by placing a securing ring radially externally of the cutting blades, or, as shown in U.S. Pat. No. 1,033,001, by means of a screw.

From U.S. Pat. No. 2,259,623 it is known to mount the replaceable blade in a slot provided in the knife holder, and to secure the cutting blade against the bottom of the slot by means of a screw, inserted in a threaded bore extending traversely of the blade through the knife holder, the screw having a conical tip for engaging a hole in the blade. In this construction, there is a risk that the screw and blade fall out of the knife holder, whereby they are mixed with the product and possibly damage the cutting assembly or other parts of the machinery.

DISCLOSURE OF THE INVENTION

It is the object of the present invention to provide an improved arrangement of the above-mentioned type, whereby the above-mentioned inconveniencies are ameliorated without unnecessarily impeding the replacement of the replaceable cutting blades.

According to the invention, this is achieved by an arrangement of the above-mentioned kind.

BRIEF DESCRIPTION OF THE DRAWINGS

The invention will be described further in the following with reference to the drawing, in which.

DESCRIPTION OF THE PREFERRED EMBODIMENT

Figure 1:
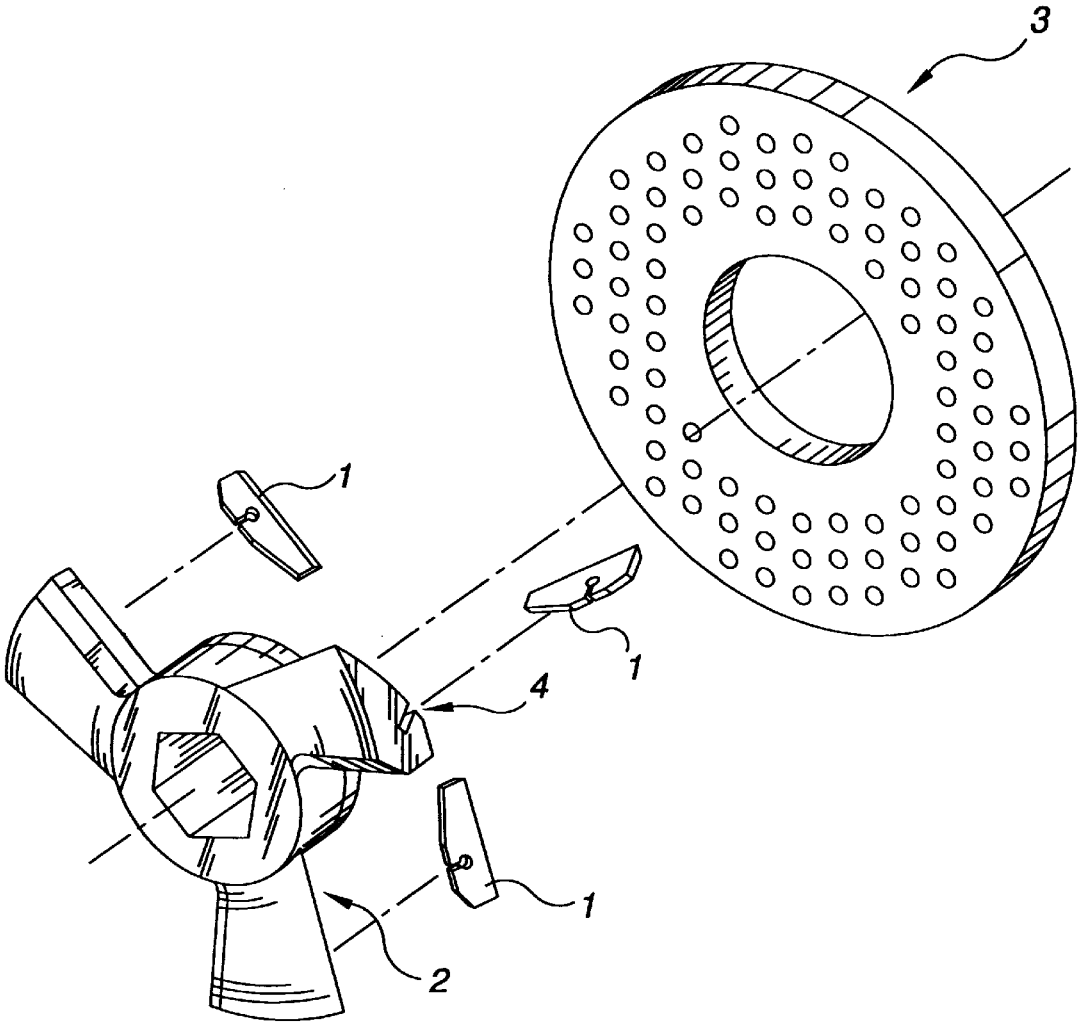
FIG. 1 shows an exploded view of an embodiment of an arrangement in accordance with the invention.

The embodiment of the arrangement for securing a replaceable cutting blade 1 on a rotating knife holder 2 in a cutting assembly in a meat mincing machine, shown in FIG. 1, is formed with a knife holder 2 with three wings, each wing being provided with a slot 4 for partially securing a cutting blade 1 in each of the wings. The rotating knife holder 2 is designed to rotate along the surface of a stationary perforated disc 3, the cutting edge of the cutting blade 1 positioned in short distance from the perforated disc 3. Usually, the cutting assembly, as shown in FIG. 1, is used at the end of a transport screw in a meat mincing machine and the rotating knife holder 2 is rotated in unison with the transport screw by means of the engagement between these, which is provided by the hexagon-formed hole in the rotating knife holder 2 shown in FIG. 1.

Figure 2:
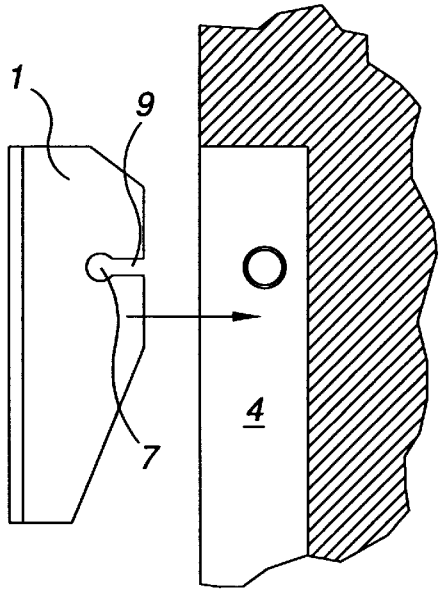
FIG. 2 shows a partial cross section along the slot in a knife holder in accordance with the invention and a cutting blade for mounting in this slot.
Figure 6:
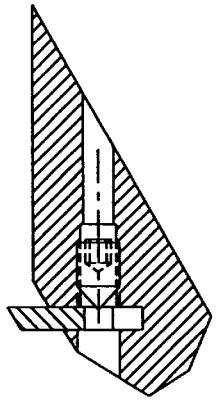
FIG. 6 shows a cross section corresponding to FIGS. 4 and 5, in which the cutting blade has been mounted, but the screw is not yet tightened.

The preferred embodiment of the cutting blade 1 shown in FIG. 2 is provided with a keyhole-formed cut-out 7 comprising a circular hole 7 and an insertion slot 9, which makes it possible to insert the cutting blade 1 in the slot 4, when the screw 5 is positioned in a position, as shown in FIG. 6. FIG. 2 shows how the cutting blade 1 is inserted into the slot 4 in the knife holder 2.

Figure 3:
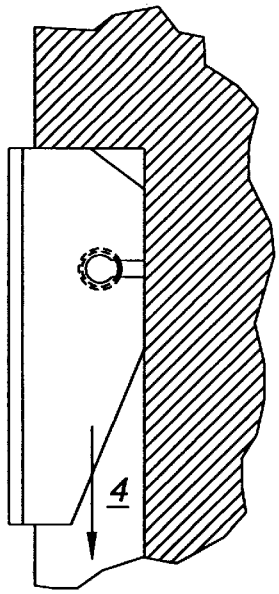
FIG. 3 shows a cross section corresponding to FIG. 2, in which the cutting blade is mounted in the slot.

FIG. 3 shows the cutting blade 1 inserted in the slot 4 in the knife holder 2 and indicates how the screw 5 engaging the circular hole 7 with the conical tip 8 of the screw 5 will press the cutting blade 1 against the bottom of the slot 4.

Figure 4:
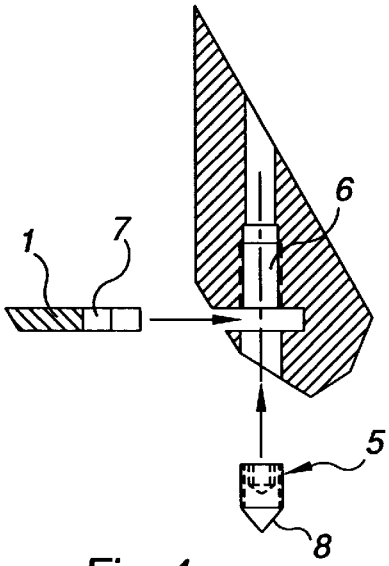
FIG. 4 shows a cross section of a knife holder corresponding to the knife holder in FIGS. 1, 2 and 3, in a plane extending traversely of the slot for the cutting blade and parallel to the direction of the threaded bore, and a cutting blade and screw, not yet mounted.

FIG. 4 shows how the screw 5 is introduced into the knife holder 2 from the backside of the wing into the threaded bore 6, the engagement means on the screw 5 for a tool being positioned against the front side of the wing. The screw 5 is screwed into the threaded bore 6 by means of a tool, until the screw 5 engages the bottom of the threaded bore, as shown in FIG. 6. Then the cutting blade 1 is inserted into the slot 4, the insertion slot 9 in the cutting blade 1 admitting the cutting blade 1 to move past the conical tip 8 of the screw 5, when the screw 5 is positioned completely screwed in, as shown in FIG. 6. Then the screw 5 is tightened, as shown in FIG. 5, until the conical tip 8 of the screw 5 engages the circular hole 7 at the back of the insertion slot 9 in the cutting blade 1.

Figure 5:
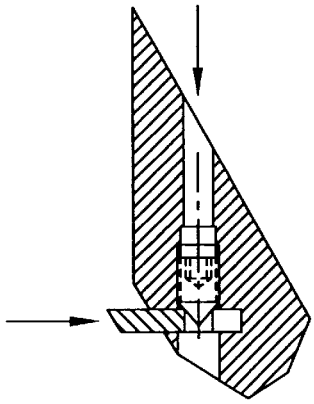
FIG. 5 shows a cross section corresponding to FIG. 4, in which the cutting blade and the screw have been mounted and tightened.

Preferably, the circular hole 7 is positioned excentrically with respect to the threaded bore 6, when the cutting blade 1 is positioned as shown in FIG. 3, the excentricity being adapted in such a way that the conical tip 8 of the screw 5 wedges the cutting blade 1 against the bottom of the slot 4 in the knife holder 2 tightening the screw 5 to the position shown in FIG. 5.

The embodiment of the arrangement in accordance with the invention shown provides several advantages compared to prior known securing arrangements. The screw 5 is prevented from falling out of the knife holder 2, being stopped at one end by the bottom of the threaded bore 6 and at the other end by the cutting blade 1. Thus, there is no danger that the screw 5 is released and mixed into the meat product, which is to be minced by means of the meat mincing machine.

The cutting blade 1 is prevented from being thrown out of the knife holder 2, even if the screw 5 is loosened, the screw 5 not being able to move further backwards in the threaded bore than to the bottom of the threaded bore, whereby the conical tip 8 of the screw 5 is still engaged in the circular hole 7 in the cutting blade 1 and thus preventing the cutting blade 1 from moving in a radial direction influenced by the centrifugal force by the rotation of the knife holder 2.

Although the invention has been explained in the foregoing in connection with a specific embodiment, it is clear that the invention is not limited to this single embodiment, several variations being possible within the scope of the appended claims, such as a variation of the number of wings on the knife holder 2, the form of the cut-out 7 and the insertion slot 9 in the cutting blade 1, etc.

What is claimed is:

1. A cutting device comprising a cutting blade secured to a rotatable holder, said rotatable holder including at least one slot that is configured and dimensioned to receive the cutting blade, and a threaded bore comprising at least two collinear sections arranged on either side of said slot; and a screw operatively associated with the threaded bore to secure the cutting blade within the slot.

2. The cutting device of claim 1, wherein the screw has a conical tip and the cutting blade has a cut-out portion for engaging said conical tip to secure the cutting blade within the slot.

3. The cutting device of claim 2 wherein the threaded bore includes stopping means for preventing the screw from being screwed into said threaded bore to a point where the conical tip is unable to engage the cut-out portion.

4. The cutting device of claim 1, wherein the cutting blade rotates along the surface of a perforated disc.

5. The cutting device of claim 1, wherein the slot has a thickness which is about the same as that of the cutting blade.

6. The cutting device of claim 1, wherein the cutting blade has an insert slot for manually inserting and removing the cutting blade when the screw is loosened, but still protrudes into the slot.

7. A method for securing a cutting blade to a rotatable holder which comprises:

providing the cutting blade with a cut-out portion and the holder with at least one slot which is configured and dimensioned to receive the cutting blade and which includes a threaded bore said threaded bore comprising at least two collinear sections arranged on either side of said slot;

inserting a screw having a conical tip into the threaded bore to a point where the conical tip extends into the slot by a sufficient distance to engage the cut-out portion;

inserting the cutting blade into the slot; and tightening said screw onto the cutting blade to secure the cutting blade in the slot.

8. A cutting device comprising a cutting blade with a cut-out portion secured to a rotatable holder, said rotatable holder including at least one slot that is configured and dimensioned to receive the cutting blade, and a threaded bore said threaded bore comprising at least two collinear sections arranged on either side of said slot, wherein the threaded bore includes stopping means for preventing the screw from being screwed into said threaded bore to a point where the conical tip is unable to engage the cut-out portion; and a screw operatively associated with the threaded bore to secure the cutting blade within the slot, wherein the screw has a conical tip and the cutting blade has a cut-out portion for engaging said conical tip to secure the cutting blade within the slot.

9. A cutting device comprising a cutting blade secured to a rotatable holder, said rotatable holder including at least one slot that is configured and dimensioned to receive the cutting blade, and a threaded bore said threaded bore comprising at least two collinear sections arranged on either side of said slot, and a screw operatively associated with the threaded bore to secure the cutting blade within the slot, said threaded bore having a screw insertion end from which the screw is inserted into the threaded bore, and an opposite tool insertion end from which a tool is inserted to engage the screw, the bore including stopping means positioned between the slot and the tool insertion end for preventing the screw from being screwed into the threaded bore to a point where the screw exits the threaded bore at the tool insertion end.

10. The cutting device of claim 9, wherein the stopping means are positioned to prevent the screw from being screwed into the threaded bore to a point where the conical tip is unable to engage a cut-out portion of the cutting blade.

11. A cutting device comprising a cutting blade secured to a rotatable holder, said rotatable holder including at least one slot that is configured and dimensioned to receive the cutting blade, and a threaded bore comprising at least two collinear sections arranged on either side of said slot; and a screw operatively associated with the threaded bore to secure the cutting blade within the slot, said screw having a conical tip and said cutting blade having a cut-out portion for engaging said conical tip to secure the cutting blade within the slot; and said threaded bore having stopping means for preventing the screw from being screwed into said threaded bore to a point where the conical tip is unable to engage the cut-out portion.

* * * * *